US007044788B2

(12) United States Patent
Maeda

(10) Patent No.: US 7,044,788 B2
(45) Date of Patent: May 16, 2006

(54) CONNECTOR

(75) Inventor: Taisaku Maeda, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/003,063

(22) Filed: Dec. 3, 2004

(65) Prior Publication Data

US 2005/0085127 A1 Apr. 21, 2005

(30) Foreign Application Priority Data

Dec. 5, 2003 (JP) ..... 2003-407702

(51) Int. Cl.
*H01R 13/40* (2006.01)

(52) U.S. Cl. ..... 439/595; 439/744

(58) Field of Classification Search ..... 439/595, 439/752, 752.5, 397–400, 596, 157, 474, 439/744, 594
See application file for complete search history.

(56) References Cited

U.S. PATENT DOCUMENTS 5,203,722 A 4/1993 Kinoshita
6,159,047 A * 12/2000 Tanaka ..... 439/595
6,375,501 B1 * 4/2002 Kojima ..... 439/595
6,682,366 B1 * 1/2004 Tanaka ..... 439/595
6,796,836 B1 * 9/2004 Ichida et al. ..... 439/595
6,817,901 B1 * 11/2004 Nishide ..... 439/595
6,872,093 B1 * 3/2005 Fukatsu et al. ..... 439/595

* cited by examiner

*Primary Examiner*—Gary F. Paumen
*Assistant Examiner*—Edwin A. Leon
(74) *Attorney, Agent, or Firm*—Gerald E. Hespos; Anthony J. Cusella

(57) ABSTRACT

In the process of inserting a terminal fitting (20) into a cavity (11), a locking portion (16) is resiliently deformed along a partition wall (12) or an outer wall (13) due to the interference with the terminal fitting (20). Escaping recesses (17) are formed in surfaces of the partition walls (12) and the outer wall 13 facing the locking portions (16), whereby the widths of the locking portions (16) can be enlarged while defining clearances between the partition walls (12) and the locking portions (16) and clearances between the outer wall (13) and the locking portions (16). Thus, an area of engagement of each locking portion (16) with the terminal fitting (20) can be enlarged to improve a retaining function of the locking portion (16).

8 Claims, 8 Drawing Sheets

CONNECTOR

BACKGROUND OF THE INVENTION

1. Field of the Invention

The invention relates to a connector with locks to retain terminal fittings.

2. Description of the Related Art

U.S. Pat. No. 5,203,722 discloses a connector with a housing formed from a synthetic resin. The housing has a plurality of side-by-side cavities partitioned by partition walls. Locks extend along inner walls of the cavities substantially at right angles to the partition walls. The locks are formed to retain terminal fittings inserted into the cavities, and prevent movements of the terminal fittings in a withdrawing direction.

The lock is deformed resiliently toward a side opposite from the cavity due to the interference with the terminal fitting in the process of inserting the terminal fitting into the cavity. Thus, clearances are required along the partition walls at the opposite sides of the lock. These clearances are spaces left by withdrawing long narrow molding portions of a mold upon molding the housing. The clearances must be wide enough to achieve sufficient strength for the molding portions. However, a wider clearance means a narrower lock, and hence a smaller area of engagement with the terminal fitting. The lock might not be sufficiently strong to retain the terminal fitting if the connector is miniaturized.

The invention was developed in view of the above problem, and an object thereof is to improve the reliability of a retaining function of a lock.

SUMMARY OF THE INVENTION

The invention is directed to a connector with a housing made of a synthetic resin. The housing has a plurality sidewalls arranged so that cavities are defined between adjacent pairs of sidewalls. Thus, each cavity is formed partly by first and second opposed sidewall surfaces of the sidewalls in the corresponding pair of sidewalls. A lock is between the sidewalls of each cavity and a width direction of each lock extends substantially normal to the sidewalls. Each lock has first and second lateral faces facing the respective first and second sidewall surfaces of the sidewalls of the respective cavity. The lock is deformed resiliently due to interference with a terminal fitting in the process of inserting the terminal fitting into the cavity. The lock then returns resiliently and engages the terminal fitting when the terminal fitting is inserted to a proper position, thereby preventing movement of the terminal fitting in the withdrawing direction. An escaping recess is formed in at least a portion of the first sidewall surface of each cavity. The escaping recess enables the lock to be wider while defining a clearance between the first sidewall surface and the lock. Thus, an area of engagement of each lock with the corresponding terminal fitting can be enlarged to improve the ability of the lock to retain the terminal fitting.

Each terminal fitting preferably has a projecting piece that extends along the second sidewall surface of the cavity and that faces the second lateral face of the corresponding lock. The escaping recess preferably is formed only in the first sidewall surface, and hence at a side opposite from the projecting piece. The thickness of the sidewall in an area where the escaping recess is formed is approximately the same as in a connector in which the escaping recesses are formed symmetrically in both sidewall surfaces of the cavity under the condition that the widths of the locks and clearances between the locks and the sidewalls are the same. Thus, forming the escaping recess only in the first sidewall surface does not reduce the strength of the sidewall.

Each terminal fitting preferably includes a base plate extending along the width direction of the lock and a side plate standing up along the inner surface of the sidewall from a lateral edge of the base plate. The first lateral face of each lock and an area of the first sidewall surface of the cavity where the escaping recess is not formed preferably are at substantially the same position along the width direction of the lock. Thus, the lock can be wider and accordingly an area of engagement of the base plate and the lock is enlarged.

DETAILED DESCRIPTION OF THE PREFERRED EMBODIMENTS

Figure 1:
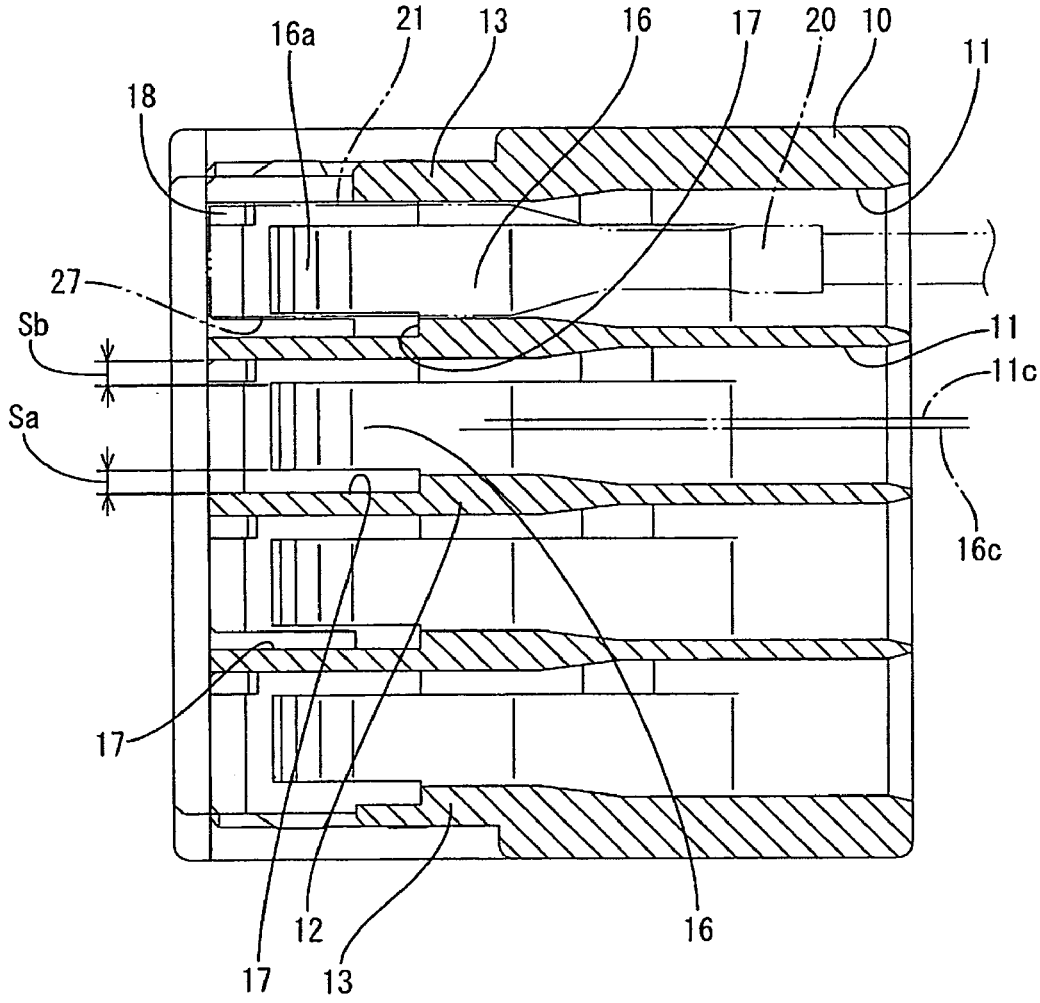
FIG. 1 is a horizontal section showing a positional relationship of cavities and locking portions along horizontal direction.

A connector in accordance with the invention is illustrated in FIGS. 1 to 8. The connector is constructed by assembling a housing 10, terminal fittings 20 and a front retainer 30. The housing 10 is made of a synthetic resin and cavities 11 are formed side by side at specified intervals along a transverse direction at each of upper and lower stages in the housing 10. The terms upper and lower are used herein as a convenient frame of reference, but are not intended to imply a required gravitational orientation. Each cavity 11 is long and narrow in forward and backward directions and the terminal fitting 20 is inserted therein from behind.

Partition walls 12 partition adjacent cavities 11, so that each cavity 11 in the middle is defined between two partition walls 12 at the left and right sides. Further, each of the two cavities 11 at the opposite left end right ends is defined between a partition wall 12 and an outer wall 13 of the housing 10. The partition walls 12 and the outer walls 13 have the same thickness dimension along the widthwise direction.

A deformation space 14 is defined below a front-end area of each cavity 11 between two partition walls 12 or between a partition wall 12 and an outer wall 13. A lock 16 is formed integrally with the housing 10 and cantilevers forward along a bottom wall 15 of the cavity 11 between the deformation space 14 and the cavity 11. The lock 16 is resiliently deformable down into the deformation space 14 between the two partition walls 12 or between the partition wall 12 and the outer wall 13. A retaining projection **16*a* is formed on the surface of each lock 16 facing the cavity 11, and a locking surface 16***b* is formed at the front of the retaining projection 16*a*. The locking surface 16*b* is aligned normal to an inserting direction of the terminal fitting 20 into the cavity 11. The width of the retaining projection 16*a* is equal to the width of the lock 16, and the opposite left and right surfaces of the retaining projection 16*a* are flush with and continuous with those of the locking portion 16.

Each of the partition walls 12 and the outer wall 13 at the left side (lower side in FIG. 1, right side in the front view of the housing 10 shown in FIG. 3) is formed with an escaping recess 17. Each escaping recess 17 is formed by recessing the right (upper in FIG. 1) inner surface of the partition wall 12 or the outer wall 13 forming the left inner wall of each cavity 11 to have an equal depth. The escaping recess 17 is formed in a range corresponding to the entire formation area of the lock 16 with respect to forward and backward directions and to the entire area defined between the position of the lock 16 in its unbiased state and that of the lock 16 resiliently deformed with respect to the vertical direction. In other words, the escaping recess 17 faces the outer surfaces of the lock 16 and the retaining projection 16*a* at the left outer surfaces. The depths of all the escaping recesses 17 along the widthwise direction are equal and substantially half the thickness of the partition walls 12.

A space Sa is defined in the transverse direction between the left outer surfaces of the lock 16 and the retaining projection 16*a* and the inner side surface of the escaping recess 17. Similarly, a space Sb is defined between the right outer side surfaces of the lock 16 and the retaining projection 16*a* at the right side and the inner left side surfaces of the partition wall 12 or the outer wall 13 at the left side. The spaces Sa and Sb are substantially equal and are selected to permit resilient deformation of the lock 16 and to ensure sufficient strength for the mold. In other words, a widthwise center position 16*c* of each lock 16 is displaced to the left from a widthwise center position 11*c* (i.e. middle position between the left inner surface of the partition wall 12 and the right inner surface of the partition wall 12 adjacent the right side) of the corresponding cavity 11. Accordingly, as compared to a connector in which the same spacing is defined between the left outer surface of a lock and the right inner surface of a partition wall or an outer inner surface formed with no escaping recess, the width of each lock 16 is larger by as much as the depth of the escaping recesses 17.

Figure 2:
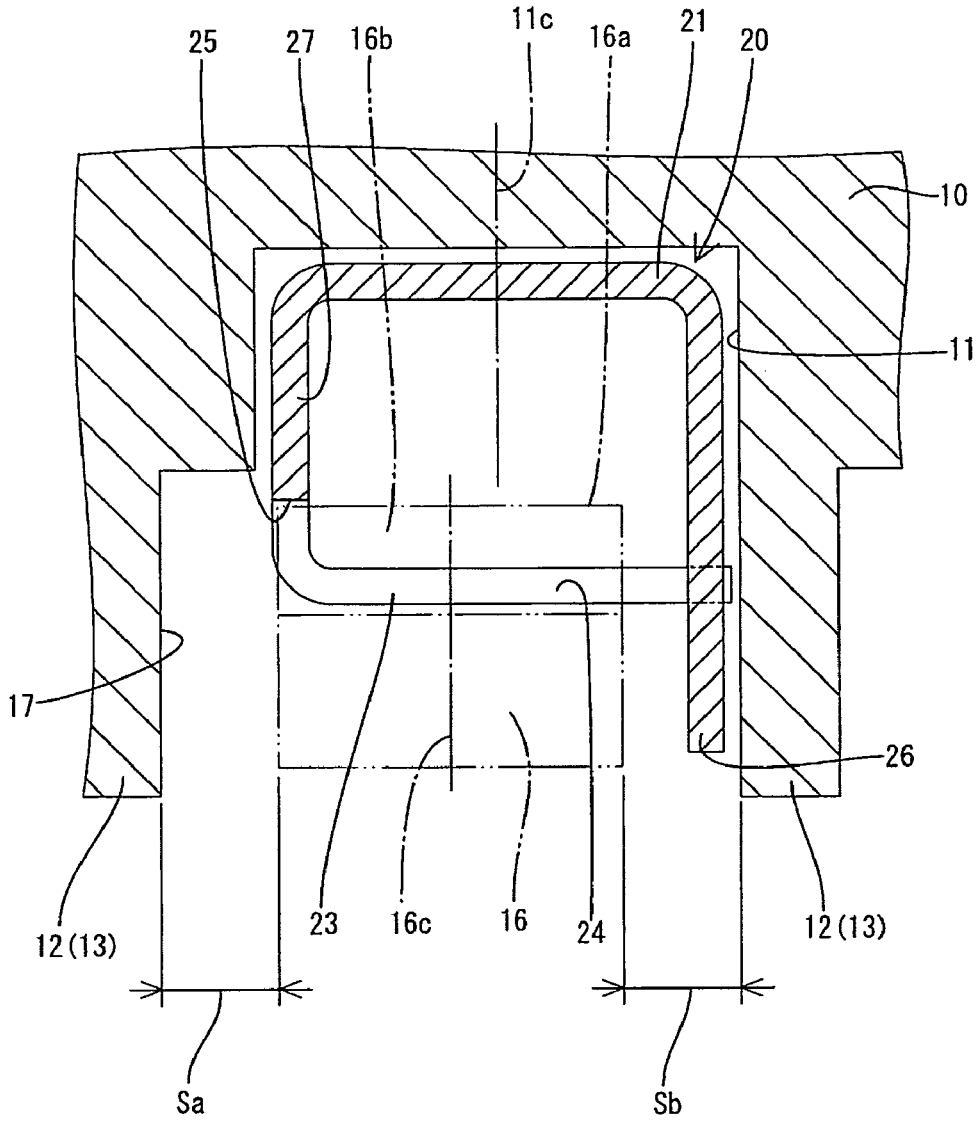
FIG. 2 is a lateral section showing an engaged state of the terminal fitting and the locking portion when viewed from behind.
Figure 3:
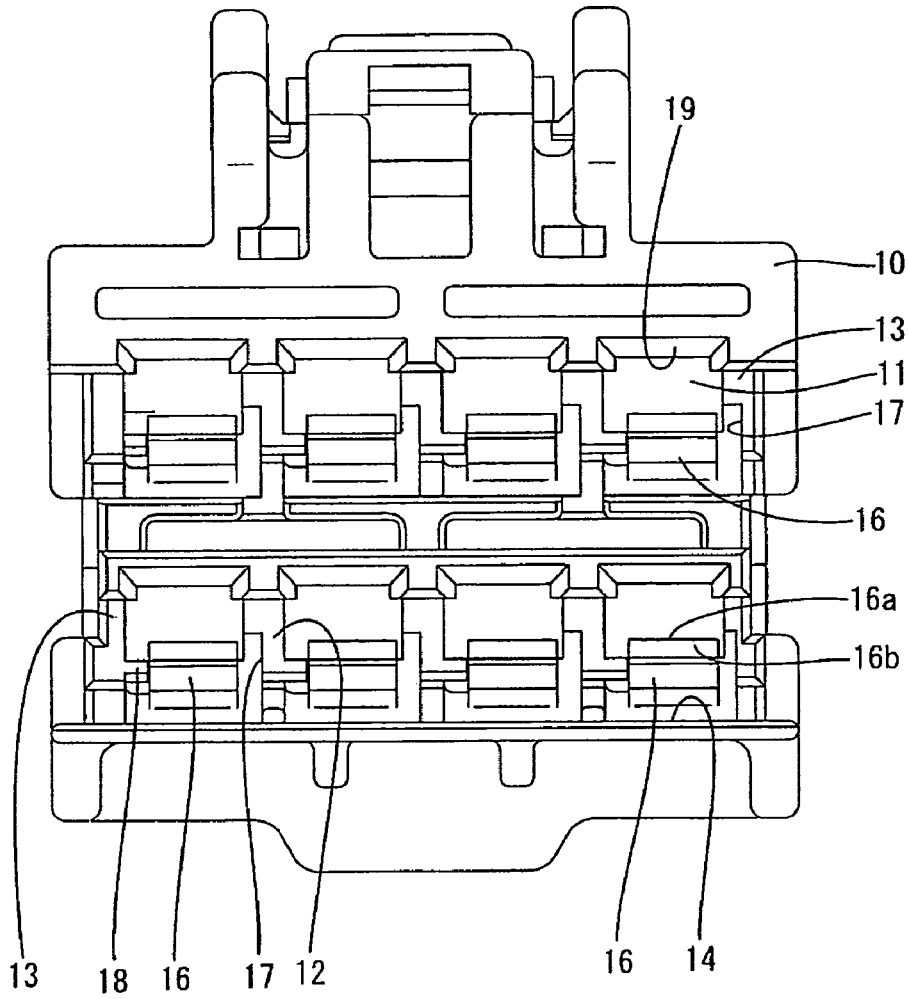
FIG. 3 is a front view of a housing with a front retainer detached.

The left outer surfaces of the locks 16 and the retaining projections 16*a* facing the escaping recesses 17 and areas of the right inner surfaces of the partition walls 12 and the left outer wall 13 where the escaping recesses 17 are not formed (e.g. areas behind the locks 16) are at substantially the same positions along the widthwise direction (transverse direction) of the locks 16. More particularly, the left outer surfaces of the locks 16 and the retaining projections 16*a* are substantially in the same plane as areas of the right inner surfaces of the partition walls 12 and the left outer wall 13 where the escaping recesses 17 are not formed, as shown in FIG. 2.

Each terminal fitting 20 is formed by bending a metal plate material that has been stamped into a specified shape. A substantially front half of the terminal fitting 20 is formed into a rectangular tube 21 and a resilient contact piece 22 is formed in the rectangular tube 21 for resiliently contacting a male tab of an unillustrated mating terminal. The rectangular tube 21 has a base plate 23 facing the upper surface of the lock 16. The base plate 23 is formed with a rectangular locking hole 24 for accommodating the retaining projection 16*a*. The locking hole 24 has a front edge aligned normal to the inserting direction of the terminal fitting 20 into the cavity 11. The locking surface 16*b* of the retaining projection 16*a* engages or is opposed to and slightly rear of the front edge of the locking hole 24 when the terminal fitting 20 is inserted to a proper position in the cavity 11.

The rectangular tube 21 also has opposite left and right plates that stand up from the opposite lateral edges of the base plate 23. A notch 25 is formed at the bottom end of the left plate 27 and communicates with the locking hole 24. The front end edge of the notch 25 is flush with and continuous with the front edge of the locking hole 24 and extends vertically straight normal to the inserting direction of the terminal fitting 20 into the cavity 11. The locking surface 16*b* of the retaining projection 16*a* engages or is opposed to and slightly rear of the front edge of the notch 25 when the terminal fitting 20 is inserted to the proper position in the cavity 11.

The right plate standing up from the base plate 23 is formed with a projecting piece 26 that extends down from the base plate 23 and flush with the right plate. As the terminal fitting 20 is inserted into the cavity 11, the projecting piece 26 moves along the left inner surface of the partition wall 12 or the outer wall 13 serving as the right wall of the cavity 11. The projecting piece 26 contacts a front-stop 18 on the right inner wall of the deformation space 14 when the terminal fitting 20 reaches the proper position. Thus, the terminal fitting 20 is stopped at its front end position. The projecting piece 26 functions as a stabilizer for stabilizing the posture of the terminal fitting 20 in the cavity 11 and prevents an upside-down insertion of the terminal fitting 20.

Figure 4:
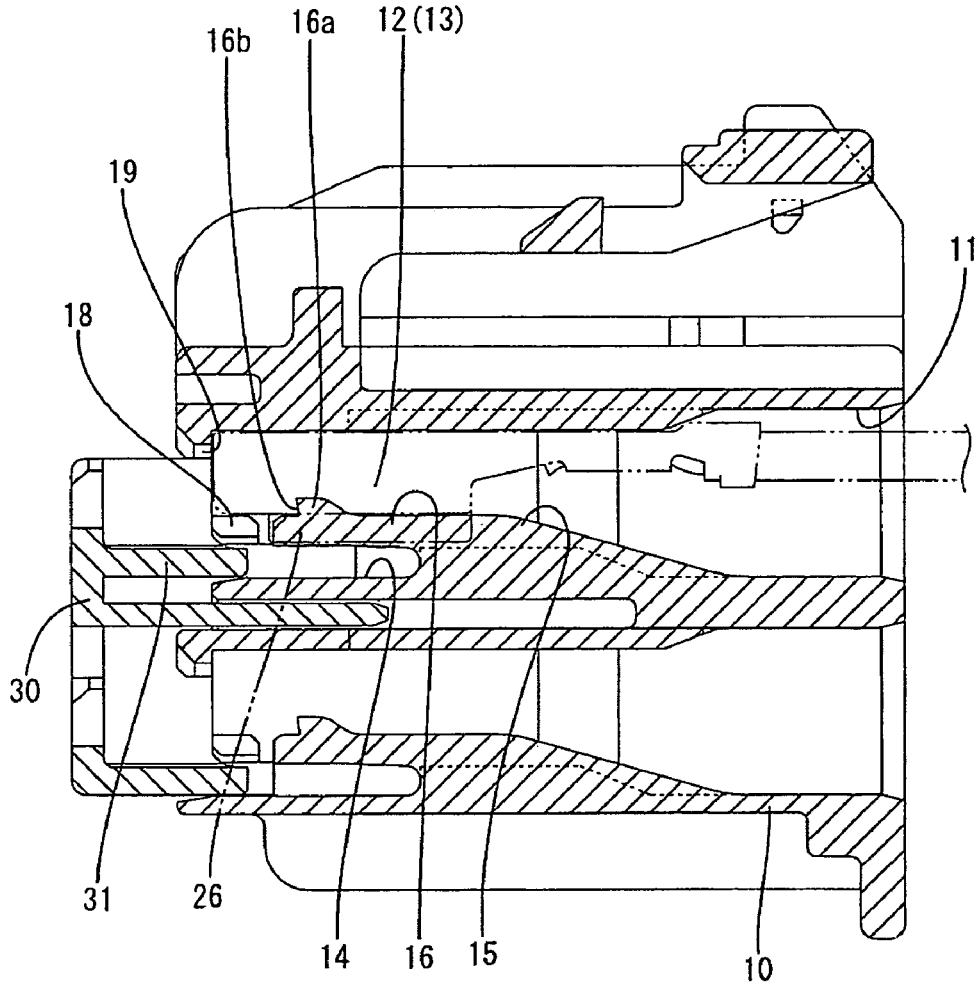
FIG. 4 is a longitudinal section of the housing with the front retainer partly locked.

The front retainer 30 is held at a partial locking position in the housing 10, as shown in FIG. 4, before inserting the terminal fittings 20 into the cavities 11. A known locking means (not shown), such as a locking projection, can be used as a means for holding the front retainer 30. In this state, the preventing pieces 31 of the front retainer 30 are in positions forward from the locks 16. Thus, the locks 16 can deform resiliently into the deformation spaces 14. Each terminal fitting 20 is inserted in this state. As a result, the front end of the base plate 23 of the rectangular tube 21 interferes with the retaining projection 16*a* and presses the lock 16 down. The lock 16 returns resiliently when the terminal fitting 20 is inserted to a proper insertion position, and the retaining projection 16*a* enters the locking hole 24. As a result, the locking surface 16*b* engages or is opposed to and slightly rearward of the front end edge of the locking hole 24 of the base plate 23 and the front end edge of the notch 25 of the right plate. Accordingly, the terminal fitting 20 is held at the proper insertion position while being prevented from making a backward displacement in the withdrawing direction. The front end edge of the upper surface of the rectangular tube 21 contacts a front-stop 19 formed at the upper edge of the front end of the cavity 11 when the terminal fitting 20 reaches the proper insertion position. Additionally, the front end of the projecting piece 26 contacts the front-stop portion 18. Therefore, the terminal fitting 20 is held at upper and lower positions so as not to move any further forward.

Figure 5:
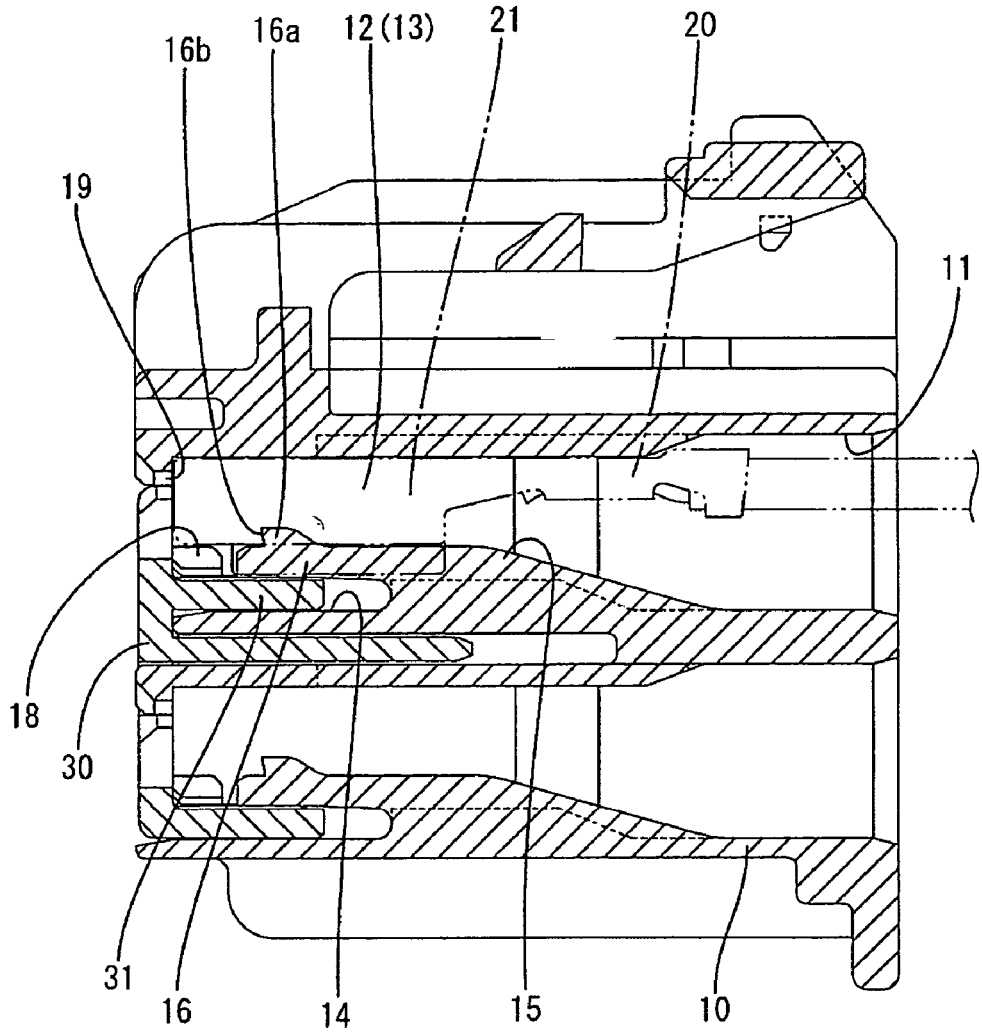
FIG. 5 is a longitudinal section of the housing with the front retainer fully locked.
Figure 6:
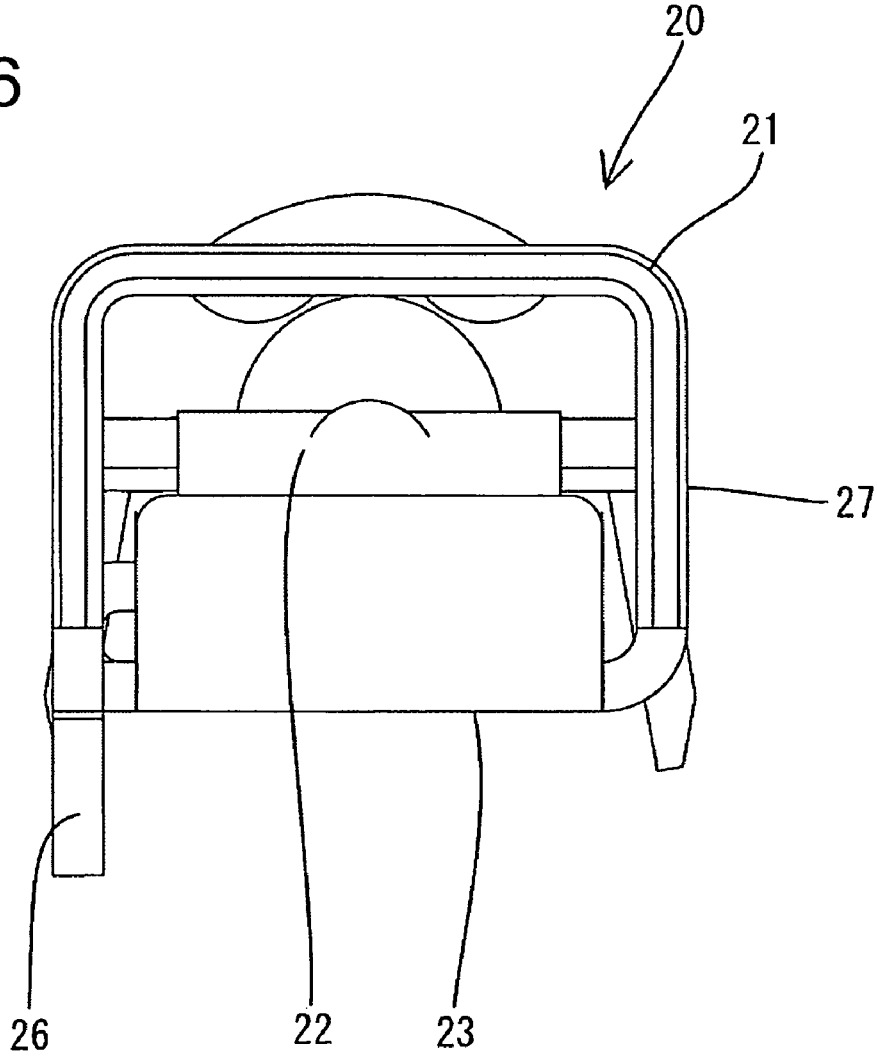
FIG. 6 is a front view of the terminal fitting.
Figure 7:
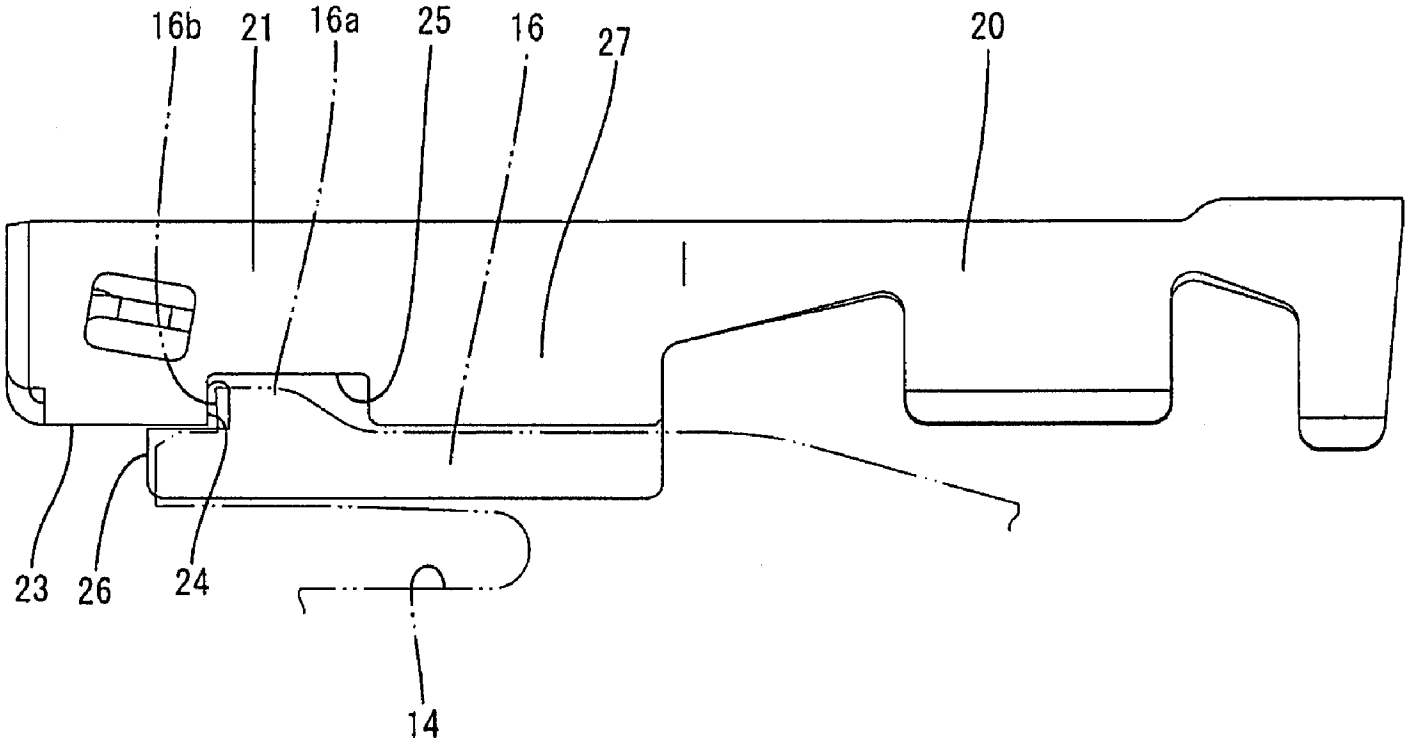
FIG. 7 is a side view of the terminal fitting.
Figure 8:
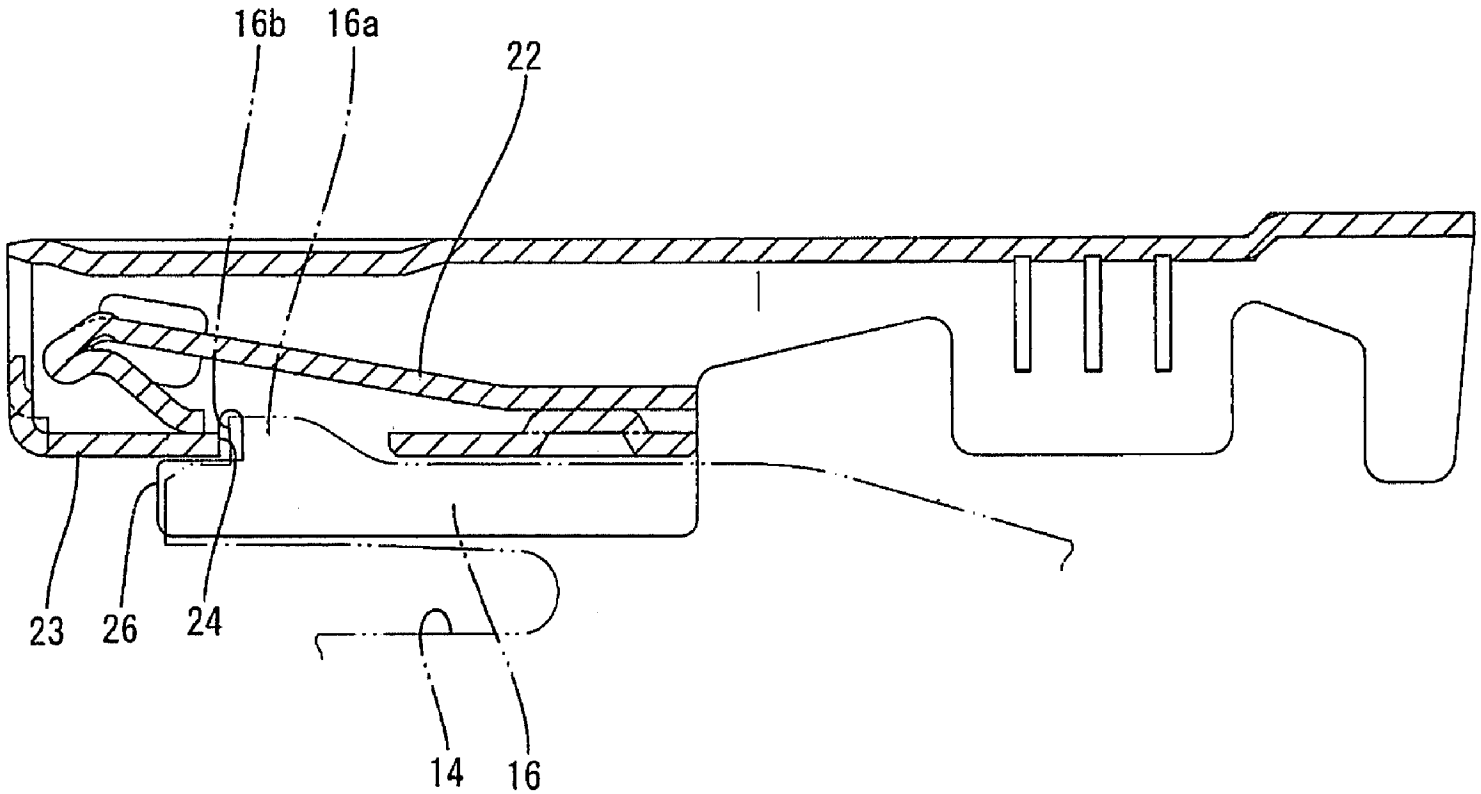
FIG. 8 is a longitudinal section of the terminal fitting.

The front retainer 30 is pushed to the full locking position shown in FIG. 5 after all of the terminal fittings 20 have been inserted. Thus, the preventing pieces 31 of the front retainer 30 enter the deformation spaces 14 to prevent displacement of the locks 16 in a direction away from the terminal fittings 20. In this way, the terminal fittings 20 are locked doubly.

As described above, the escaping recesses 17 are formed in the right inner surfaces of the partition walls 12 and the outer wall 13 facing the locks 16. Thus, the locks 16 and the retaining projections 16*a* can be wider while still defining the necessary clearances between the partition walls 12 and the locks 16 and between the outer wall 13 and the locks 16. Thus, areas of engagement of the retaining projections 16*a* with the front end edges of the locking holes 24 of the terminal fittings 20 can be enlarged along the width direction, thereby improving a function of retaining the terminal fittings 20.

The rectangular tube 21 of each terminal fitting 20 has the base plate 23 extending along the width direction of the lock 16 and the left plate 27 standing up from the lateral edge of the base plate 23 along the right inner surface of the partition wall 12 or the outer wall 13. The left outer surface of the lock 16 facing the escaping recess 17 and the area of the right inner surface of the partition wall 12 or the outer wall 13 where the escaping recess 17 is not formed are substantially at the same position with respect to the width direction of the lock 16. Additionally, the notch 25 defines an area of engagement between the left plate 27 and the lock 16 along a direction normal to the width of the lock 16. Therefore, the lock 16 retains the terminal fitting 20 reliably.

Each terminal fitting 20 is formed with the projecting piece 26 extending along the left inner surface of the partition wall 12 or the outer wall 13, which defines the right wall of the cavity 11. Since the escaping recess 17 is formed only in the left inner surface of the partition wall 12 or the outer wall 13, the projecting piece 26 can extend along the right inner surface of the partition wall 12 or the outer wall 13 from the start of the insertion of the terminal fitting 20 till the end of the insertion when the terminal fitting 20 reaches the proper insertion position. The thickness of the areas of the partition walls 12 and the outer wall 13 where the escaping recesses 17 are formed is same as in a connector (not shown) in which escaping recesses are symmetrically formed in both partition walls or the partition wall and the outer wall at the opposite sides of each lock under the condition that the widths of the locks 16 and the clearances between the locks 16 and the partition walls 12 or outer wall 13 are the same. Therefore, forming the escaping recesses 17 only at the left sides of the locks 16 does not reduce the strengths of the partition walls 12 and the outer wall 13.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

Although the escaping recess is formed only in one wall in the foregoing embodiment, it may be formed in each of the two walls at the opposite sides of the lock according to the present invention. In such a case, the escaping recesses may be transversely symmetrically formed so that the widthwise center of the lock and that of the cavity coincide.

Each projecting piece functions as a stabilizer for stabilizing the posture of the terminal fitting in the cavity and preventing an upside-down insertion of the terminal fitting in the foregoing embodiment. However, the invention is also applicable to cases where the projecting piece does not function as a stabilizer.

The surface of each lock facing the escaping recess and the area of the inner surface of the wall where the escaping recess is not formed are at substantially the same position along the widthwise direction of the locking portion in the foregoing embodiment. However, they may be displaced along the width direction of the lock according to the present invention in the case that the escaping recess is formed only in one wall portion.

Although each lock is engaged with both the base plate and the side plate of the engaging portion of the terminal fitting in the foregoing embodiment, it may be engaged only with the base plate according to the invention.

What is claimed is:

1. A connector, comprising a housing made of a synthetic resin and formed with walls arranged so that cavities are defined between two adjacent walls, terminal fittings being insertable into the respective cavities, resiliently deformable locks formed in the cavities, each lock being resiliently deformable substantially parallel to the walls in response to interference with one of said terminal fittings while inserting the terminal fitting into the cavity, the lock being engaged with the terminal fitting when the terminal fitting is inserted to a proper position for substantially preventing movement of the terminal fitting in a withdrawing direction, and an escaping recess being formed in a surface of a first of the walls substantially facing the lock in each of the cavities, and a second of the walls in each of the cavities having no escaping recess, each of the terminal fittings having a projecting piece extending between the second wall and the lock of the respective cavity.

2. The connector of claim 1, wherein the escaping recesses all are of substantially equal depth and are equal to about one-half of a thickness of the respective wall.

3. The connector of claim 1, wherein a space between the lock and an inner side surface of the escaping recess substantially equals a space between the lock and an inner side surface of the wall opposite the recess.

4. The connector of claim 1, wherein each terminal fitting has an engaging portion for engaging the corresponding lock, the engaging portion including a base plate extending along a width direction of the lock and a side plate standing up along the inner surface of the wall from a lateral edge of the base plate.

5. The connector of claim 4, wherein the surface of each lock facing the escaping recess and an area of the inner surface of the wall adjacent the escaping recess are at substantially a common position along the width direction of the lock.

6. The connector of claim 4, wherein the surface of each lock facing the escaping recess and an area of the inner surface of the wall adjacent the escaping recess are substantially in a common plane.

7. A connector housing with opposite front and rear ends and being formed with substantially parallel walls, cavities being defined between each of said walls and an adjacent one of said walls, each of said cavities extending forwardly from the rear end of the housing and being formed by first and second opposed side surfaces on the walls of the respective cavity, locks being formed in the cavities and being resiliently deflectable in directions substantially parallel to the walls, each of said locks having opposite first and second lateral sides facing the respective first and second side surfaces of the cavity, escaping recesses extending into the front end of the housing and being formed in a portion of the first side surface of each of said cavities substantially facing the first lateral side of the respective lock, the first lateral side of each said lock being substantially aligned with a portion of the first side surface offset from the escaping recess, the second side surface of each said cavity having no escaping recess.

8. A connector housing formed with substantially parallel spaced-apart walls, cavities being defined between adjacent pairs of said walls, resiliently deflectable locks being formed between the walls in each of said pairs of walls and substantially adjacent the cavities, the locks being deformable in directions substantially parallel to the walls, a deformation space being defined between the walls in each of said pairs of walls and on a side of the lock opposite the cavity, an escaping recess being formed in first of said walls in each of said pairs of walls at a position facing the respective lock and facing the respective deformation space, a second of said walls in each of said pairs of walls having no recess, each said lock being substantially symmetrically disposed between the portions of the walls having the escaping recess and being nonsymmetrically disposed relative to portions of the walls defining the respective cavity.

* * * * *